US010858899B2

(12) United States Patent
Michael

(10) Patent No.: US 10,858,899 B2
(45) Date of Patent: Dec. 8, 2020

(54) CORE SAMPLER WITH IMPREGNATION WINDOWS AND METHOD FOR STABILIZATION OF UNCONSOLIDATED SEDIMENT IN CORE SAMPLES

(71) Applicant: Saudi Arabian Oil Company, Dhahran (SA)

(72) Inventor: Nikolaos A. Michael, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 160 days.

(21) Appl. No.: 15/866,730

(22) Filed: Jan. 10, 2018

(65) Prior Publication Data

US 2019/0211638 A1 Jul. 11, 2019

(51) Int. Cl.

| | |
|---|---|
| ***E21B 25/06*** | (2006.01) |
| ***E21B 25/10*** | (2006.01) |
| ***E02D 1/04*** | (2006.01) |
| ***E21B 25/08*** | (2006.01) |

(52) U.S. Cl.

CPC ..... *E21B 25/10* (2013.01); *E02D 1/04* (2013.01); *E21B 25/08* (2013.01)

(58) Field of Classification Search

CPC combination set(s) only.
See application file for complete search history.

(56) References Cited

U.S. PATENT DOCUMENTS

| | | | |
|---|---|---|---|
| 1,373,492 | A | 4/1921 | Dodds |
| 2,698,737 | A | 1/1955 | Dean |
| 3,298,450 | A | 1/1967 | Sato |
| RE28,127 | E | 8/1974 | Derry |

(Continued)

FOREIGN PATENT DOCUMENTS

| | | | |
|---|---|---|---|
| CN | 202865873 | | 4/2013 |
| JP | 60185133 | A | 9/1985 |

(Continued)

OTHER PUBLICATIONS

International Search Report and Written Opinion for related PCT application PCT/US2019/012239 dated Apr. 11, 2019; pp. 1-12.

(Continued)

*Primary Examiner* — Taras P Bemko
*Assistant Examiner* — Ronald R Runyan
(74) *Attorney, Agent, or Firm* — Bracewell LLP; Constance G. Rhebergen; Vivek P. Shankam

(57) ABSTRACT

A core sampling apparatus includes an inner tube configured to collect a core sample by means of a core catcher attached to one end of the core sampling apparatus, and an outer tube co-axially disposed on the outside of the inner tube, wherein the inner tube includes a plurality of impregnation windows configured to allow resin to flow into the core sample, each window including a window opening and a window cover configured to cover the window opening. A method for sampling a core includes extracting a core sample using a core sampler, transporting the inner tube containing the core sample to the surface, impregnating the core sample with a resin by allowing the resin to flow into the core sample through a plurality of impregnation windows formed on the inner tube, and allowing for the resin to cure, thereby stabilizing unconsolidated sediment in the core sample.

12 Claims, 5 Drawing Sheets

(56) References Cited

U.S. PATENT DOCUMENTS

| | | | | |
|---|---|---|---|---|
| 3,948,292 | A * | 4/1976 | Goto | F16L 59/027 138/113 |
| 4,014,393 | A * | 3/1977 | Hensel, Jr. | E21B 25/00 175/58 |
| 4,177,624 | A | 12/1979 | Kelpin | |
| 4,930,587 | A | 6/1990 | Young et al. | |
| 4,946,000 | A | 8/1990 | Gibson et al. | |
| 5,253,720 | A | 10/1993 | Radford et al. | |
| 5,419,211 | A | 5/1995 | Rodel et al. | |
| 6,009,960 | A | 1/2000 | Leitko, Jr. et al. | |
| 6,443,243 | B1 | 9/2002 | Griffin, Jr. | |
| 2008/0283298 | A1 | 11/2008 | Garcia et al. | |
| 2010/0084193 | A1 | 4/2010 | Livingstone | |

FOREIGN PATENT DOCUMENTS

| | | | |
|---|---|---|---|
| JP | 2014077231 | A | 5/2014 |
| KR | 20030077055 | A | 10/2003 |
| RU | 2188299 | C2 | 8/2002 |

OTHER PUBLICATIONS

Gardner, Kenneth L.; "Impregnation technique using colored epoxy to define porosity in petrographic thin sections" Can. J. Earth Sci. vol. 17 1980; pp. 1104-1108.

* cited by examiner

CORE SAMPLER WITH IMPREGNATION WINDOWS AND METHOD FOR STABILIZATION OF UNCONSOLIDATED SEDIMENT IN CORE SAMPLES

TECHNICAL FIELD

Example embodiments generally relate to coring sediments from the earth, and more specifically relate to an apparatus and method for coring unconsolidated sediments from the earth.

BACKGROUND

Wellbores are sometimes drilled into subterranean formations that contain hydrocarbons to allow recovery of the hydrocarbons. The formation materials encountered while drilling into a subterranean formation can vary widely depending on the location and depth of the desired reservoir. In order to properly characterize the materials in a wellbore, one or more samples may be taken and tested to determine a variety of properties of the materials. Specific samples may be taken in various forms including cuttings from the formation in the returned drilling fluids during drilling or samples cut for testing that are commonly referred to as core samples.

Core samples may be cut using core cutters to produce the samples in a variety of diameters and lengths. The resulting core samples may then be tested in a testing apparatus to determine one or more physical properties of the sample such as the permeability, porosity, fluid flow or fluid or gas saturations in the sample. Special testing apparatuses may be used and specific methods may be carried out to determine the various properties of the samples. Core samples acquired in the subsurface of the earth are generally recovered with a core tube that either has a disposable inner tube or a disposable inner tube liner. At the surface, the core tube is separated from the coring assembly and placed on the drilling rig floor or other work area.

If the core material is unconsolidated, the core is "stabilized" to prevent mechanical damage caused by handling and shipment. Core stabilization may either be by freezing with dry ice to artificially consolidate the core, or by filling an annular space of the core tube with a non-reactive core stabilizing compound, for example, epoxy or gypsum. FIG. 1 illustrates, in transverse cross section, an inner tube or wall 102 enclosing a core sample 104. Because core sample 104 does not completely fill inner tube or wall 102, a void space 106 remains in an interior of inner tube 102, which may be filled to prevent core sample 104 from moving within inner tube or wall 102, to prevent damage to the core by handling and shipment of the samples. In both the epoxy fill or gypsum fill techniques, the inner tube, which may be thirty feet or more in length, is first sectioned into approximately one meter segments. Each segment is placed on a rack in a near horizontal position to drain any drilling fluid, or mud, from the inner tube. The base of the segment is then stabilized. After the base is stabilized, the segment is placed in a near vertical position and the entire segment stabilized. Thus, the present methodologies entail substantial handling of the inner tube and enclosed core sample, and the sample is thus susceptible to mechanical damage caused by vibration, jarring, or other movement.

Thus, there is a need in the art for apparatus and methods that reduce the risk of core damage and the stabilization of core samples in inner tubes. In particular, there is a need in the art for techniques that reduce the movement and handling of the inner tube, and the contained core in the stabilization process, and, which advantageously permits stabilization of the full length of the inner tube without the need for segmenting the inner tube and contained core sample.

SUMMARY

Accordingly, example embodiments described relate to a core sampling apparatus and method for micro-coring unconsolidated or friable sediments and sediment solidification with resin impregnation. The unconsolidated sediment can be loose or friable sand or it can be soil in the vadose zone, with or without moisture. The core sampler is pushed into the sediment and retrieved largely undisturbed. The present core sampling apparatus allows resin impregnation such that the solidified core can be inspected and analyzed by different petrographic techniques depending on the type of data desired.

One example embodiment is a core sampling apparatus including an inner tube configured to collect a core sample by means of a core catcher attached to one end of the core sampling apparatus, and an outer tube co-axially disposed on the outside of the inner tube. The inner tube may include a plurality of impregnation windows that may be configured to allow resin to flow into the core sample. Each window may further include a window opening and a window cover configured to cover the window opening. The window cover may open outwardly from the inner tube. The core sampling apparatus may further include a top cap configured to cover a top portion of the outer tube, and a protective ring configured to cover a base of the outer tube. The protective ring may replace the core catcher after the core sample has been collected. The window cover may be attached to the inner tube by means of a metal hinge on one side of the window cover. The window cover may be closed during a sampling operation and the outer tube may be configured to prevent the window cover from opening during the sampling operation. The core catcher may further include a plurality of metal membranes configured to collect core sample from a subsurface formation. The plurality of impregnation windows, together, may span any percentage of the entire length of the inner tube but sufficiently spaced to access the sample. A length of each of the plurality of impregnation windows may be approximately 1 centimeter or more. The top cap may further include a pump connection configured to be connected to a vacuum pump for facilitating resin impregnation and minimizing undesired air bubbles. The resin includes at least one of epoxy, vinylester, and polyester.

Another example embodiment is a method for sampling a core. The method may include extracting a core sample using a core sampler. The core sampler may include an inner tube, an outer tube co-axially disposed on the outside of the inner tube, and a core catcher attached to one end of the core sampler. The method may further include replacing the core catcher with a protective ring configured to cover the base of the outer tube, and transporting the inner tube containing the core sample to the surface. The method may further include impregnating the core sample with a resin by allowing the resin to flow into the core sample through a plurality of impregnation windows formed on the inner tube, and allowing for the resin to cure, thereby stabilizing unconsolidated or friable sediment in the core sample. The method may also include providing the core catcher with a plurality of metal membranes configured to collect core sample from a subsurface formation. The method may also include adding a dye to the resin, prior to impregnating, to allow identification of porosity during subsequent petrographic analysis. Each window may include a window opening and a window cover configured to cover the window opening, where the window cover opens outwardly from the inner tube. The window cover may be closed during a sampling operation, and the outer tube may be configured to prevent the window cover from opening during the sampling operation. The method may also include attaching the window cover to the inner tube by means of a metal hinge on one side of the window cover.

In some embodiments, the method may also include providing a top cap for covering a top portion of the outer tube, and providing a protective ring for covering a base of the outer tube. The protective ring may replace the core catcher after the core sample has been collected. The method may also include providing the top cap with a pump connection, and connecting the pump connection to a vacuum pump for creating a vacuum to ease sampling of the core. The method may also include providing the inner tube with a pump connection, and connecting the pump connection to a vacuum pump for facilitating resin impregnation and minimizing undesired air bubbles. The resin includes at least one of epoxy, vinylester, and polyester.

Another example embodiment is a core sampler including an inner tube configured to collect a core sample by means of a core catcher attached to one end of the core sampler, and an outer tube co-axially disposed on the outside of the inner tube. The inner tube includes a plurality of impregnation windows configured to allow resin to flow into the core sample. Each window may further include a window opening and a window cover configured to cover the window opening, where the window cover opens outwardly from the inner tube. The window cover may be attached to the inner tube by means of a metal hinge on one side of the window cover. The window cover may be closed during a sampling operation and the outer tube may be configured to prevent the window cover from opening during the sampling operation.

BRIEF DESCRIPTION OF THE DRAWINGS

So that the manner in which the features, advantages and objects of the example embodiments, as well as others which may become apparent, are attained and can be understood in more detail, more particular description of the example embodiments briefly summarized previously may be had by reference to the embodiment which is illustrated in the appended drawings, which drawings form a part of this specification. It is to be noted, however, that the drawings illustrate only example embodiments and is therefore not to be considered limiting of its scope as the example embodiments may admit to other equally effective embodiments. Like numbers refer to like elements throughout.

DETAILED DESCRIPTION

The methods and systems of the present disclosure will now be described more fully with reference to the accompanying drawings in which embodiments are shown. The methods and systems of the present disclosure may be in many different forms and should not be construed as limited to the illustrated embodiments set forth in this disclosure; rather, these embodiments are provided so that this disclosure will be thorough and complete, and will fully convey its scope to those skilled in the art.

Figure 1:
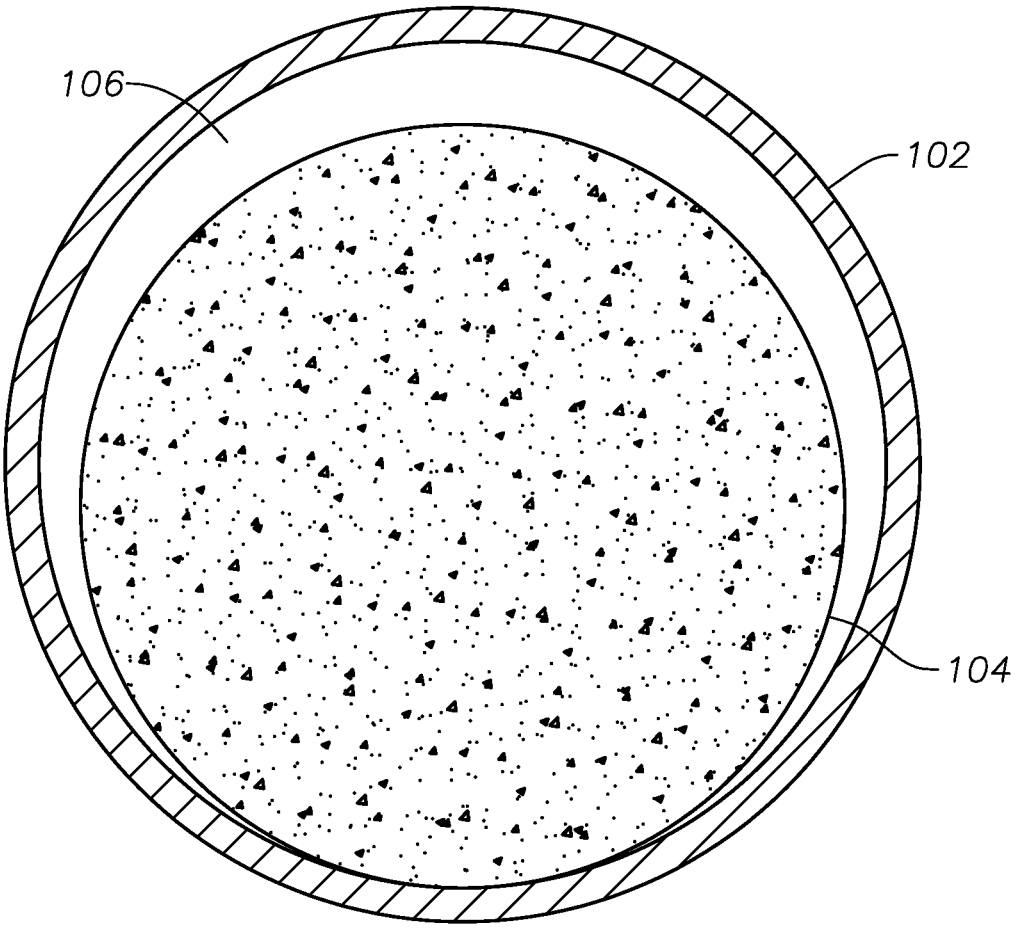
FIG. 1 (Prior Art)
FIG. 1 is a transverse cross sectional view of an inner tube or wall of a core sampler, according to teachings of the prior art.
Figures 2A, 2B, 2C:
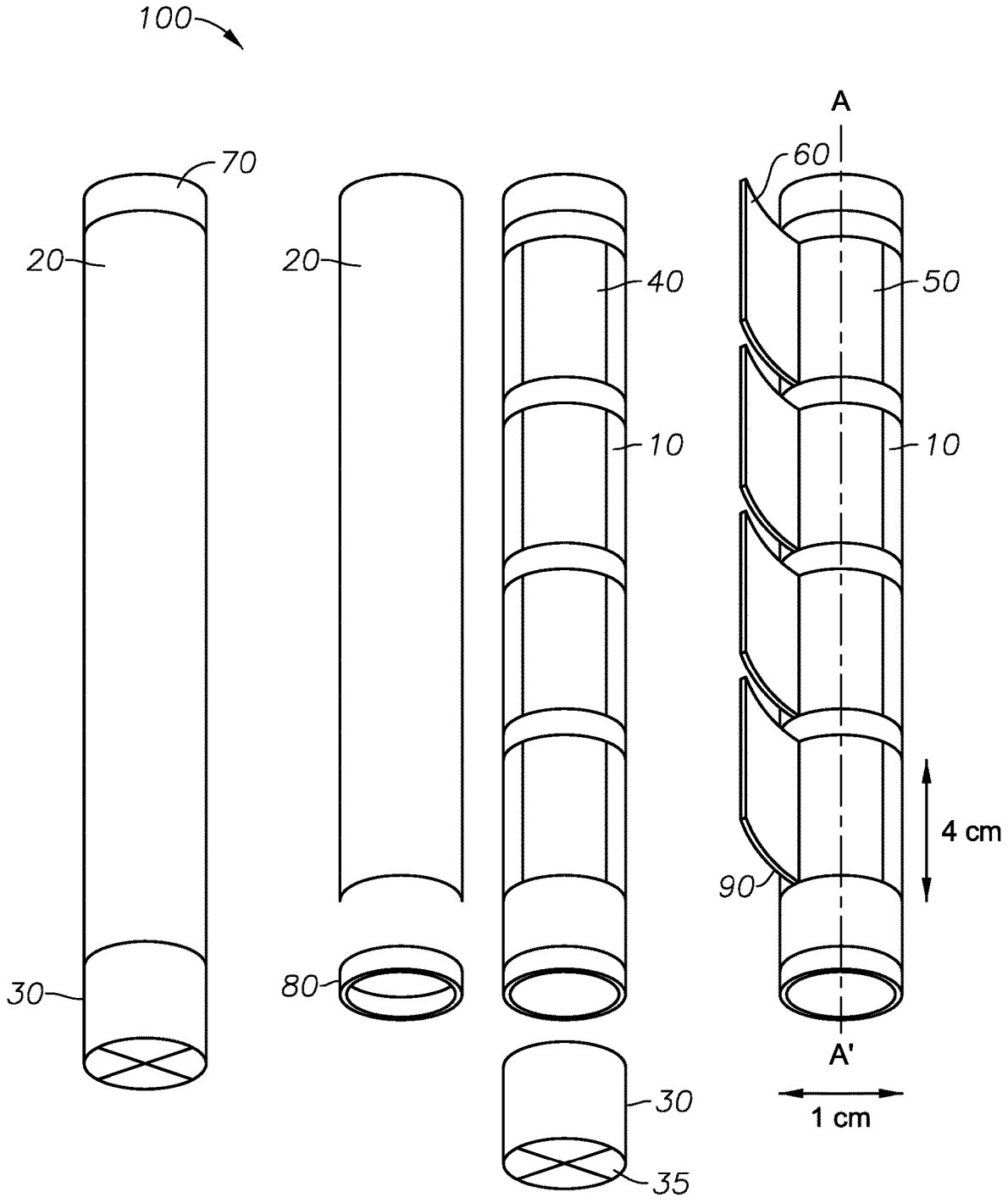
FIGS. 2A-2C illustrate different views of a core sampling apparatus, according to one or more example embodiments of the disclosure.

Turning now to the figures, FIGS. 2A-2C illustrate perspective views of a core sampling apparatus or core sampler 100, according to one or more example embodiments of the disclosure. The core sampling apparatus or sampler 100 may include an inner tube 10 (shown in FIGS. 2B and 2C), which may be configured to collect a core sample by means of a core catcher 30 (shown in FIGS. 2A and 2B) attached to one end of the core sampling apparatus 100. The core sampling apparatus or core sampler 100 may further include an outer tube 20 that may be co-axially disposed on the outside of the inner tube 10, as shown in FIGS. 2A and 2B, for example. As illustrated in FIGS. 2B and 2C, the inner tube 10 may include a plurality of impregnation windows 40 configured to allow resin (not shown here) to flow into the core sample. Each window 40 may include a window opening 50 and a window cover 60 that may be configured to cover the window opening 50, as shown in FIG. 2C, for example. The window cover 60 opens outwardly from the inner tube, and may be attached to the inner tube 10 by means of a metal hinge 90 on one side of the window cover 60. The window cover 60 may be closed during a sampling operation and the outer tube 20 may be configured to prevent the window cover 60 from opening during the sampling operation. In some embodiments, the core catcher 30 may further include a plurality of metal membranes 35 configured to collect core sample from a subsurface formation. The impregnation windows 40, together, may span any percentage of the entire length of the inner tube 10 but sufficiently spaced to access the sample, and in some cases 90% or even 95% of the entire length of the inner tube 10. According to one example embodiment, the length of each of the impregnation windows 40 may be approximately 1 centimeter or more.

The core sampler 100 may further include a top cap 70 (shown in FIG. 2A, for example) that may be configured to cover a top portion of the outer tube 20, and a protective ring 80 (shown in FIG. 2B, for example) that may be configured to cover a base of the outer tube 10. The protective ring may in some cases replace the core catcher 30 after the core sample has been collected in the inner tube 10. The sampling of unconsolidated sediment is the standard process of pushing the core sampler 100 into the sediment or soil. The sediments should have some moisture to hold together when brought to the surface. If the sediments/soils are completely dry, small amounts of water should be sprinkled on top of the desired location for sampling. Membranes 35 can be placed on both ends of the inner tube 10 to allow liquids, such as connate water and resin, to flow out, but holding the sediments in place once the sample is brought to the surface.

After sampling, the core sampler 100 is placed horizontally and the outer tube 20 is separated from the inner tube 10 of the core sampler 100 to allow the impregnation windows 40 to open, as illustrated in FIG. 2C, for example.

A resin, such as epoxy, vinylester, or polyester may be filled through these windows 40 on the surface of the core sampler 100 that allows to solidify the entire core. This technique is ideal for solidification of long thin samples as it increases the contact area by providing wide access points for the resin to enter and therefore allows complete solidification of loose sediments. The solidified core can be inspected and analyzed by different petrographic and digital imaging techniques depending on the type of analyses required.

Figure 3:
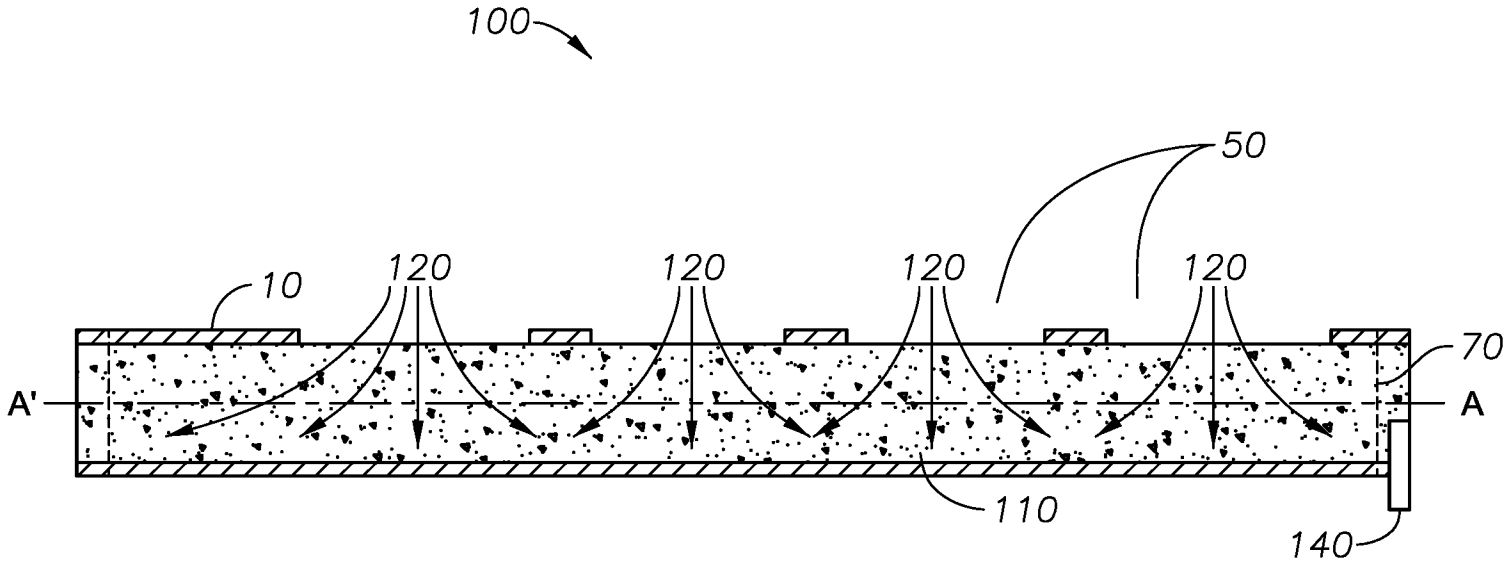
FIG. 3 is a cross-sectional view of the core sampler illustrated in FIG. 2C along line A-A', according to one or more example embodiments of the disclosure.

FIG. 3 is a cross-sectional view of the core sampler 100 illustrated in FIG. 2C along line A-A', according to one or more example embodiments of the disclosure. As illustrated in this figure, a resin 120 may be applied through the openings 50 in the windows and impregnate the core sample 110. The impregnation process is enhanced in comparison to methods of impregnation and solidification of samples through the top of the core sampler. Multiple windows openings 50 provide entry points for the resin 120, minimize the distance that a single flow of resin 120 needs to travel through the matrix and the grains of the sample. In some embodiments, the top cap 70 of the core sampler 100 may be provided with a pump connection 140, which may be connected to a vacuum pump (not shown) for creating a vacuum to ease sampling of the core. In some embodiments, the pump connection 140 may be connected to a vacuum pump for facilitating resin impregnation and minimizing undesired air bubbles.

The inner tube 10 may be made of a non-reactive material that does not react with the resin 120. In some embodiments, the resin 120 for impregnation may be mixed with blue dye to allow the identification of porosity during subsequent petrographic analysis. Sufficient time can be allowed for resin 120 to cure, and after solidification, the core sample 110 shall be removed from the sampler 100. In some embodiments, a second impregnation with resin 120 may be required if undesired air-bubbles need to be removed. The solidified core can be inspected and analyzed by different petrographic and digital imaging techniques depending on the type of data desired. Although any resin known to one of skill in the art may be used for the purpose, epoxy, vinylester, polyester, and combinations thereof are just a few examples. In some embodiments, the resin may have a low viscosity, for example less than 600 centipoise (cps), to enable faster impregnation into the sediment. The resin may also have a high drying rate such that it stabilizes the sediment in less than two hours, or even in less than one hour. The flow rates of the resin 120 should be sufficient to fill void space within a working time of the resin mixture. However, flow rates must be sufficiently slow that the flow rate of resin 120 within void space will not generate stresses in core sample that might disturb or disrupt the sample. In an embodiment in which the stabilizing compound is epoxy, a flow rate of 0.01 gallons per minute may be used, however, other flow rates may also be used and would be within the spirit and scope of the disclosure.

Figure 4:
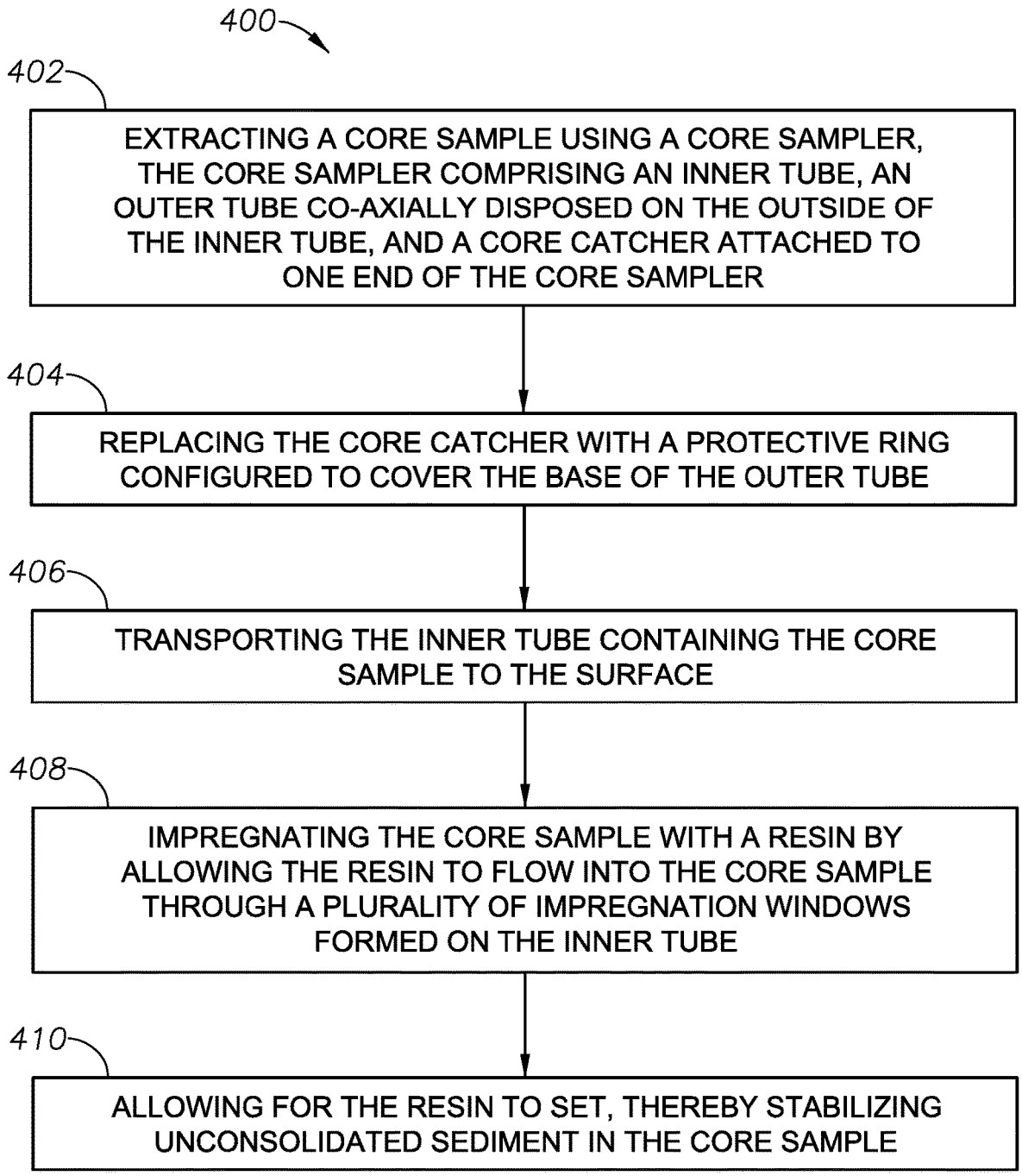
FIG. 4 illustrates example steps in a method for stabilization of unconsolidated sediment in core samples, according to one or more example embodiments of the disclosure.

FIG. 4 illustrates example steps in a method 400 for stabilization of unconsolidated or friable sediment in core samples, according to one or more example embodiments of the disclosure. At step 402, the method may include extracting a core sample using a core sampler. The core sampler may include an inner tube, an outer tube co-axially disposed on the outside of the inner tube, and a core catcher attached to one end of the core sampler. At step 404, the method may include replacing the core catcher with a protective ring that may be configured to cover the base of the outer tube. At step 406, the method may include transporting the inner tube containing the core sample to the surface. At step 408, the method may include impregnating the core sample with a resin by allowing the resin to flow into the core sample through a plurality of impregnation windows formed on the inner tube. Although any resin known to one of skill in the art may be used for the purpose, epoxy, vinylester, polyester, and combinations thereof are just a few examples. At step 410, the method may include allowing for the resin to cure, thereby stabilizing unconsolidated or friable sediment in the core sample. In some embodiments, the method may also include providing the core catcher with a plurality of metal membranes that are configured to collect core sample from a subsurface formation. The method may also include adding a dye to the resin, prior to impregnating, to allow identification of porosity during subsequent petrographic analysis. Each window may include a window opening and a window cover configured to cover the window opening, where the window cover opens outwardly from the inner tube. The window cover may be closed during a sampling operation, and the outer tube is configured to prevent the window cover from opening during the sampling operation. The method may also include attaching the window cover to the inner tube by means of a metal hinge on one side of the window cover.

Figure 5:
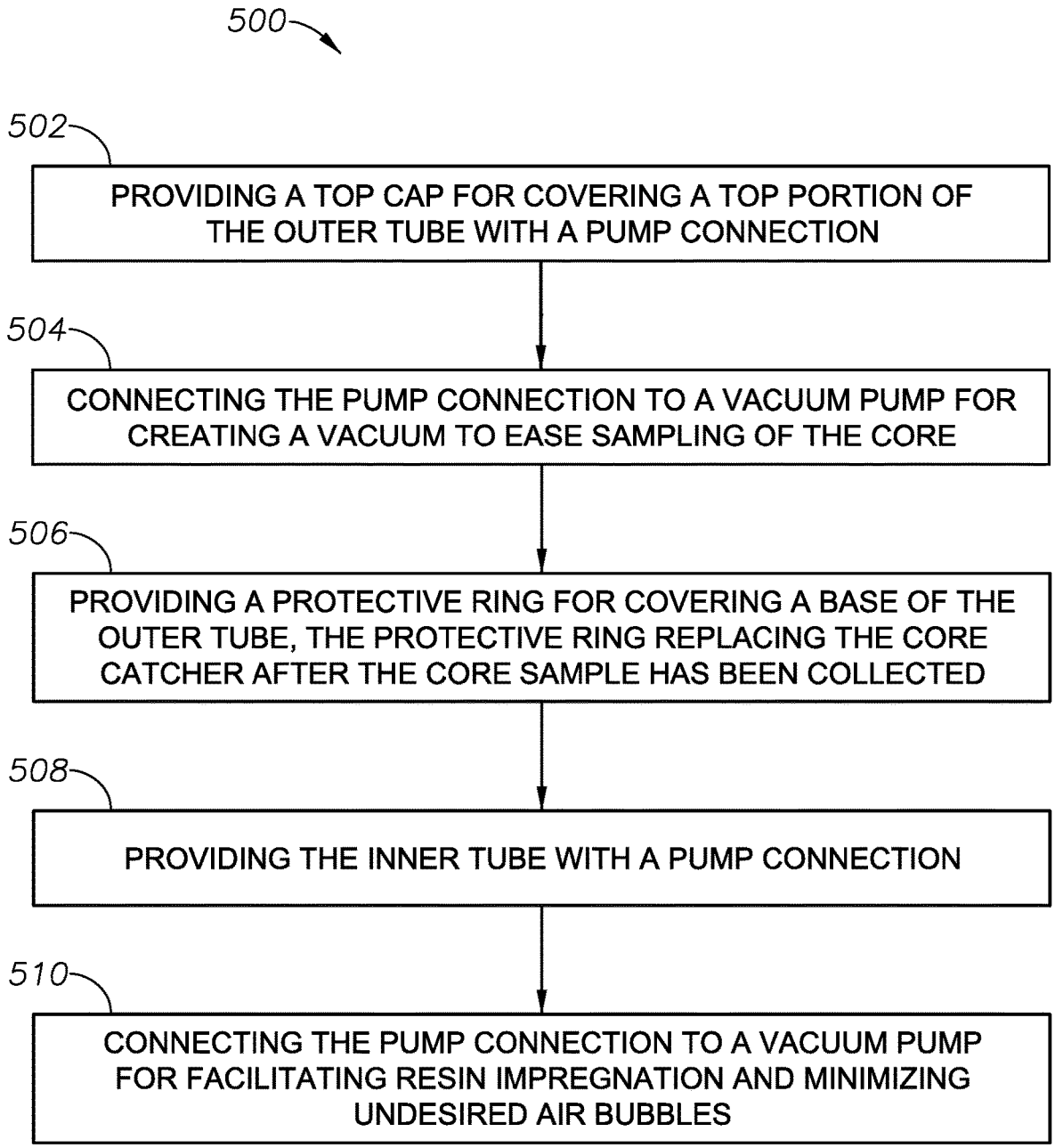
FIG. 5 illustrates example steps in a method for stabilization of unconsolidated sediment in core samples, according to one or more example embodiments of the disclosure.

FIG. 5 illustrates additional example steps in a method 500 for stabilization of unconsolidated or friable sediment in core samples, according to one or more example embodiments of the disclosure. At step 502, the method may also include providing a top cap for covering a top portion of the outer tube, and providing the top cap with a pump connection. At step 504, the pump connection may be connected to a vacuum pump for creating a vacuum to ease sampling of the core. At step 506, the method may include providing a protective ring for covering a base of the outer tube, the protective ring replacing the core catcher after the core sample has been collected. At step 508, the method may also include connecting the pump connection to a vacuum pump for facilitating resin impregnation and minimizing undesired air bubbles, at step 510. Although any resin known to one of skill in the art may be used for the purpose, epoxy, vinylester, polyester, and combinations thereof are just a few examples. In some embodiments, the resin may have a low viscosity, for example less than 600 centipoise (cps), to enable faster impregnation into the sediment. The resin may also have a high drying rate such that it stabilizes the sediment in less than two hours, or even in less than one hour. The flow rates of the resin 120 should be sufficient to fill void space within a working time of the resin mixture. However, flow rates must be sufficiently slow that the flow rate of resin 120 within void space will not generate stresses in core sample that might disturb or disrupt the sample. In an embodiment in which the stabilizing compound is epoxy, a flow rate of 0.01 gallons per minute may be used, however, other flow rates may also be used and would be within the spirit and scope of the disclosure.

In this way, a core stabilization apparatus and method are provided. A core sample within an inner tube may be stabilized using a resin mixture without first sectioning the inner tube and enclosed core sample. The core sample is stabilized along the entire length of the inner wall by simultaneously injecting the resin into the wall through a plurality of windows provided in the inner tube. Before injecting the resin mixture, drilling mud remaining within the inner tube is expelled using a displacing gas introduced into a plurality of vent ports provided in the inner tube. The vent ports also permit the displacement of gas within the inner wall void space during injection of the core stabilizing compound, and, additionally, allow for the escape of any excess resin supplied during the injection process.

The Specification, which includes the Summary, Brief Description of the Drawings and the Detailed Description, and the appended Claims refer to particular features (including process or method steps) of the disclosure. Those of skill in the art understand that the example embodiments includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this example embodiments belong unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements or operations. Thus, such conditional language generally is not intended to imply that features, elements or operations are in any way required for one or more implementations or that one or more implementations necessarily include logic for deciding, with or without user input or prompting, whether these features, elements or operations are included or are to be performed in any particular implementation.

The systems and methods described, therefore, are well adapted to carry out the objects and attain the ends and advantages mentioned, as well as others that may be inherent. While example embodiments of the system and method has been given for purposes of disclosure, numerous changes exist in the details of procedures for accomplishing the desired results. These and other similar modifications may readily suggest themselves to those skilled in the art, and are intended to be encompassed within the spirit of the system and method disclosed and the scope of the appended claims.

The invention claimed is:

1. A core sampling apparatus comprising:

an inner tube configured to collect a core sample by means of a core catcher attached to one end of the core sampling apparatus; and an outer tube co-axially disposed on the outside of the inner tube, wherein the inner tube comprises a plurality of openings to allow resin to flow into the core sample, each opening having a corresponding cover to fully cover the opening, wherein the cover opens outwardly from the inner tube, wherein the cover is attached to the inner tube by means of a metal hinge on one side of the cover, wherein the cover is closed during a sampling operation and the outer tube prevents the cover from opening during the sampling operation, wherein after the inner tube containing the core sample is transported to the surface, the outer tube is separated from the inner tube, and a resin is applied through the plurality of openings to impregnate the core sample, thereby stabilizing unconsolidated sediment in the core sample, and wherein the stabilized core sample is removed via the opening of the inner tube after solidification of the resin.

2. The apparatus of claim 1, further comprising:

a top cap configured to cover a top portion of the outer tube; and a protective ring configured to cover a base of the outer tube, the protective ring replacing the core catcher after the core sample has been collected.

3. The apparatus of claim 1, wherein the core catcher comprises a plurality of metal membranes configured to collect core sample from a subsurface formation.

4. The apparatus of claim 1, wherein a length of each of the plurality of openings is approximately 1 centimeter or more.

5. The apparatus of claim 1, wherein the inner tube further comprises a pump connection, the pump connection configured to be connected to a vacuum pump for facilitating resin impregnation and minimizing undesired air bubbles.

6. The apparatus of claim 1, wherein the resin comprises at least one of epoxy, vinylester, and polyester.

7. A method for sampling a core, the method comprising:

extracting a core sample using a core sampler, the core sampler comprising an inner tube, an outer tube co-axially disposed on the outside of the inner tube, and a core catcher attached to one end of the core sampler;

replacing the core catcher with a protective ring configured to cover the base of the outer tube;

transporting the inner tube containing the core sample to the surface;

impregnating the core sample with a resin by allowing the resin to flow into the core sample through a plurality of openings formed on the inner tube, each opening having a corresponding cover to fully cover the opening, wherein the cover opens outwardly from the inner tube, wherein the cover is attached to the inner tube by means of a metal hinge on one side of the cover, wherein the cover is closed during a sampling operation and the outer tube prevents the cover from opening during the sampling operation;

allowing for the resin to cure, thereby stabilizing unconsolidated sediment in the core sample; and removing the stabilized core sample via the opening of the inner tube after solidification of the resin.

8. The method of claim 7, further comprising:

adding a dye to the resin, prior to impregnating, to allow identification of porosity during subsequent petrographic analysis.

9. The method of claim 7, further comprising:

providing a top cap for covering a top portion of the outer tube; and providing a protective ring for covering a base of the outer tube, the protective ring replacing the core catcher after the core sample has been collected.

10. The method of claim 9, further comprising:

providing the top cap with a pump connection; and connecting the pump connection to a vacuum pump for creating a vacuum to ease sampling of the core.

11. The method of claim 7, wherein the resin comprises at least one of epoxy, vinylester, and polyester.

12. The method of claim 7, further comprising:

providing the core catcher with a plurality of metal membranes configured to collect core sample from a subsurface formation.

* * * * *